US005586750A

United States Patent [19]

Ezoe

[11] Patent Number: 5,586,750

[45] Date of Patent: Dec. 24, 1996

[54] GUIDE TYPE CABLE ENGINE

[76] Inventor: Takuji Ezoe, 2-7-14, Tsukushino, Machida-shi, Tokyo, Japan

[21] Appl. No.: 378,373

[22] Filed: Jan. 25, 1995

[30] Foreign Application Priority Data

Mar. 30, 1994 [JP] Japan ..... 5-082716

[51] Int. Cl.[6] ..... B63B 35/03

[52] U.S. Cl. ..... 254/134.3 SC

[58] Field of Search ..... 254/134.3 SC, 254/134.3 R, 134.4; 405/168.4, 168.3, 168.1, 166; 53/450, 550, 474

[56] References Cited

U.S. PATENT DOCUMENTS

| | | | |
|---|---|---|---|
| 2,435,347 | 2/1948 | Gilman | 53/450 |
| 4,995,217 | 2/1991 | Francis | 53/450 |
| 5,197,716 | 3/1993 | Zibilich et al. | 405/166 |
| 5,199,659 | 4/1993 | Zibilich | 254/134.3 SC |
| 5,442,897 | 8/1995 | Hinzmann et al. | 53/450 |

OTHER PUBLICATIONS

Unabara No. 10, Nov., 1993.
Unabara No. 11, Feb., 1994.

*Primary Examiner*—Robert C. Watson
*Attorney, Agent, or Firm*—Nikaido, Marmelstein, Murray & Oram LLP

[57] ABSTRACT

A cloth guide type cable engine for taking out a cable (2) to be paid out through a stern of a barge deck (1) to the sea bottom. The cloth guide cable engine has an inner cloth guide (7) made of cloth fastened in an elongated cylindrical shape which tightly encloses a main pull rope (3), and an outer cloth guide (9) made of cloth fastened in an elongated cylindrical shape which encloses the inner cloth guide (7), a cable (2) to be paid out, and an umbilical cable (4). The inner guide (7) is located at a predetermined position in cross section in the outer guide (9).

4 Claims, 2 Drawing Sheets

GUIDE TYPE CABLE ENGINE

FIELD OF THE INVENTION

The present invention relates to an improvement in a cable engine which is used for burying a submarine cable or the like in a sea floor, and more particularly, relates to an improvement in a cable engine paying out accurate length of a cable automatically so that a cable should follow the sea bed, and avoid undesirable tension in the cable after being laid.

BACKGROUND OF THE INVENTION

The ideal laying of a submarine cable is to place a cable along the sea bottom with minimum necessary length of cable in order that a submarine cable may be laid with just sufficient slack. Therefore, a conventional cable ship is equipped with a drum type or a linear type cable engine.

In a cable laying operation between two points, a cable engine is able to pay out a cable by length which is actual distance between two points and some slack which is additional length of several % of the distance. The slack is determined from topography data about the sea bed which is preliminarily surveyed, and the speed of a cable ship across the sea bottom measured by using a taut wire gear.

On the other hand, in cable burial operation, a cable paid out must pass through a cable burier before being set on the sea bed. Even if a cable engine pays out a slack, the slack will be stocked or stored at the entrance of the cable burier before the slack reaches the sea bottom, and the cable would bend, and/or would be rubbed and damaged.

Therefore, for safety so that a cable is not damaged, a cable is paid out with high tension, so as not to be stored at the entrance of a cable burier. As a result, a paid out cable would be unburied because of high tension, even if a trench is dug in the sea bed with enough depth. For that reason, a prior drum type cable engine and a prior linear type cable engine are not suitable for burying a cable.

Recently, an iron ring cable guiding equipment or a cylindrical cage (JP patent laid open 7010/1991) is used for providing a path of a cable and repeaters from a ship to a cable burier. That equipment or a cage is also useful for realizing ideal "no-cable-tension, and no-cable-slack" condition to a burial cable.

The iron guiding equipment, however, has the disadvantage that it is heavy in weight and it needs wide space for storage. Therefore, the burial operation by using an iron guiding equipment is limited up to 200 m in sea depth. Accordingly, it does not meet the latest demand of burial operation in the deeper (over 1000 m) sea bed.

The cylindrical cage which is made of cloth has no such disadvantage, and it discharges well its duty as a cable guiding equipment in deep sea water. However, when it is used as a cable engine in deep sea water, because of the power of brake standing for the factor Wh, which is mentioned later, it is impossible to compare favorably with a foresaid drum type cable engine etc.

Therefore, at present, no cable engine for a burial operation in deep sea exists.

SUMMARY OF THE INVENTION

It is an object, therefore, of the present invention to overcome the disadvantages and limitations of a prior cable engine by providing a new and improved cable engine. It is also an object of the present invention to provide a cable engine for burying a cable in deep sea bed deeper than 1000 m.

It is also an object of the present invention to provide a cable engine which handles safely both a cable and a repeater.

It is also an object of the present invention to provide a cable engine which pays out suitable cable length with no undesirable tension and no undesirable slack.

The above and other objects are attained by a cable engine comprising; an inner guide (7) made of resilient sheet fastened an elongated cylindrical shape enclosing tightly a main pull rope (3); an outer guide (9) made of resilient sheet fastened in an elongated cylindrical shape enclosing the inner guide (7), and a cable (2) to be paid out; wherein the inner guide is located at a predetermined position in the outer guide.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
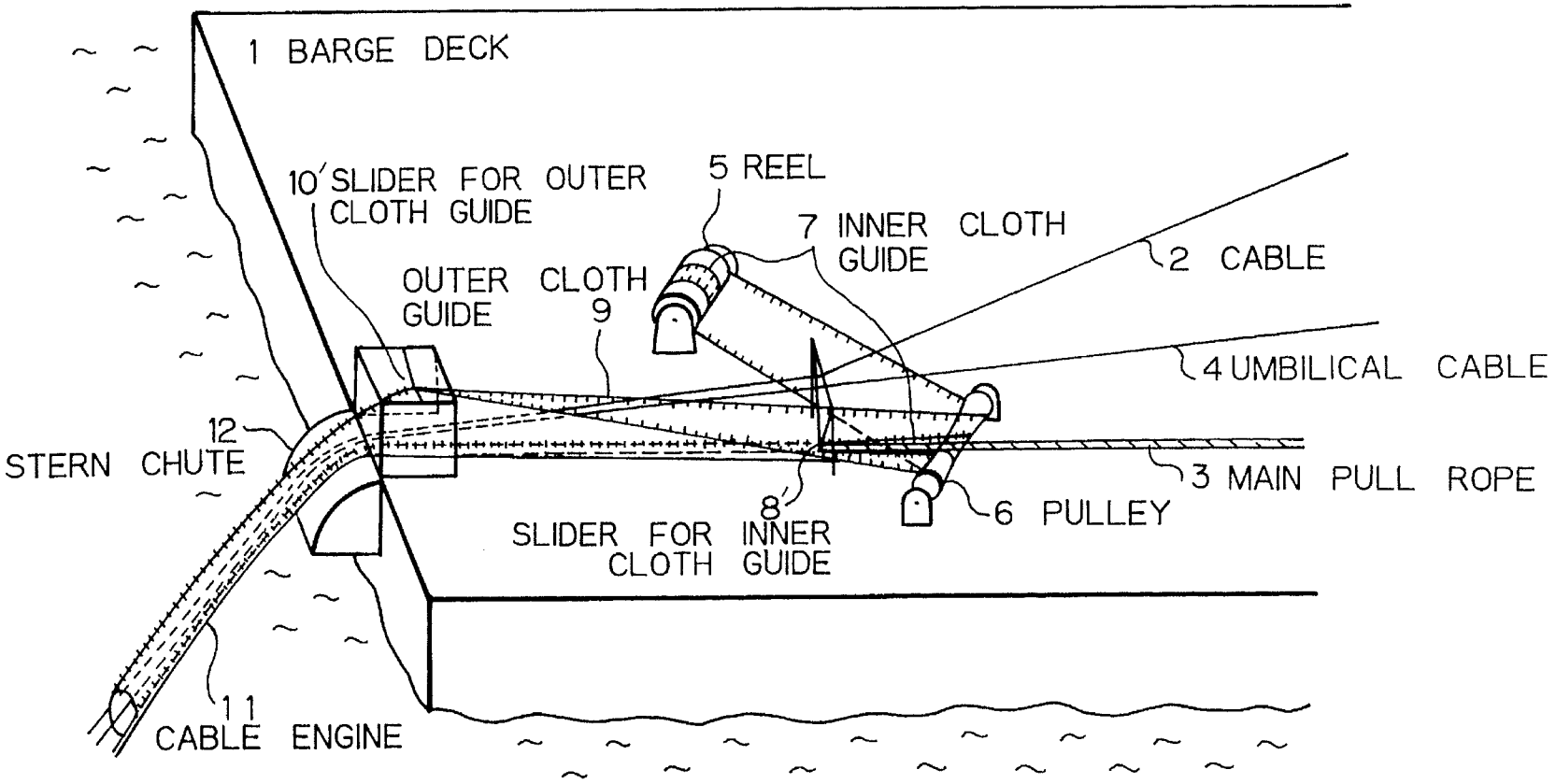
FIG. 1 shows perspective view of a cable engine according to the present invention.

The theory of cable laying shows that a cable tension at a stern of a ship in a conventional operation is equal to Wh, where h is the depth of the sea water, and W is the weight of a cable per unit length. Therefore, in order that a cable guiding equipment is used as a cable engine, it is necessary that it has the capability of endurance for the cable tension Wh.

Conventionally, an outer cloth guide near the stern suffers from the large accumulated forces generated by friction between the outer cloth guide and a cable to be paid out. The forces operate as the brake for a cable. In order to solve that problem, according to the present invention, an outer cloth guide is continuously fastened to a main pull rope which is enclosed in an inner cloth guide so that a main pull rope is loaded with the above mentioned forces, and an outer cloth guide is released from the forces. Therefore, this invention removes the restriction of the sea depth applied for prior cable guiding equipment.

In case cable guiding equipment and/or a cable is twisted, a cable and repeaters can't pass through it. In the worst case, repeaters would be broken and a cable would be cut out. In the present invention, a main pull rope which is subject to a tension is fixed at a predetermined location in an outer guide, and therefore, there is no possibility that an outer guide is twisted at any place in the equipment. Therefore, a cable guiding equipment would be twisted only when apparatuses are errorneously at stern of a ship, or when a cable burier is turned over.

Further, when they are equipped, since a main rope always having tension contacts with a stern chute, an outer cloth guide which is fixed to a main pull rope would not be twisted on the stern chute. This invention is, therefore, useful to prevent apparatuses from twisting.

Further, an outer cloth guide which is fastened to a main pull rope will obviously contribute to prevent a cable moving in a guiding equipment from tangling with a main pull rope.

In order to use a cable engine in operation similar to a drum type cable engine and/or a linear type cable engine, a cable guiding equipment must only not have the ability to hold a cable without being torn, but also have an angle Θ between the present apparatus and horizontal direction large enough so that the touch down point of a cable guiding equipment at the sea bottom comes near the cable ship, and have a friction coefficient with a cable large enough for getting sufficient brake power.

The theory of cable laying shows that the incidence angle in the former is:

$$\theta = k\sqrt{W/R}$$

where

W: cable weight per unit length in water

R: hydrodynamic resistance k: constant

As noted in the above formula, if we try to make cable guiding equipment light in weight by changing the material from conventional iron to plastic, the incidence angle becomes too small. Therefore, it is necessary that the hydrodynamic resistance of guiding equipment R is reduced at the same ratio in order to keeping the angle Θ. The present invention is advantageous in the above point. The hydrodynamic resistance by the present cable guiding equipment which encloses a main pull rope, an umbilical cable or an auxiliary rope, is reduced as small as the case that only a main rope is set alone in water, because the cloth operates similar to a so-called "fairing" (stream lined cover).

The weight of a cloth cable guiding equipment including a main pull rope, an umbilical cable or an auxiliary rope, and a cable to be paid out is only one fifth of that of a conventional iron ring guiding equipment including a rope and cables. Nevertheless, as above mentioned, the hydrodynamic resistance of the present invention is reduced almost one-fourth or one fifth of the latter. Therefore, the incidence angle in the present invention in water is almost the same as that of the latter.

Further, for the friction coefficient, the coefficient of friction by a conventional iron ring guiding equipment is about 0.2, and that of the present cloth guiding equipment is 0.4–0.5, which is almost doubled. Generally, a cable to be paid out passes through guiding equipment in a straight line mode or a zigzag line mode depending upon the tension. In the case of a conventional iron ring guiding equipment, a cable is only supported by running water. Therefore, the effective friction can't be obtained in a straight line portion. On the other hand, in the present cloth guiding equipment, a cable is always supported by running water through a cloth, and therefore, friction is obtained in not only on the zigzag line portion but also in the straight line portion.

As mentioned above, a cloth guiding equipment according to the present invention solves the problem of tension, and is very light in weight compared with an iron ring guiding equipment, and has a similar incidence angle to that of the latter. Further, the present aparatus has better operational characteristic for friction as a cable engine than that of a conventional cable engine having iron rings.

The embodiment of the present invention is explained in detail in accordance with the drawings.

Figure 2:
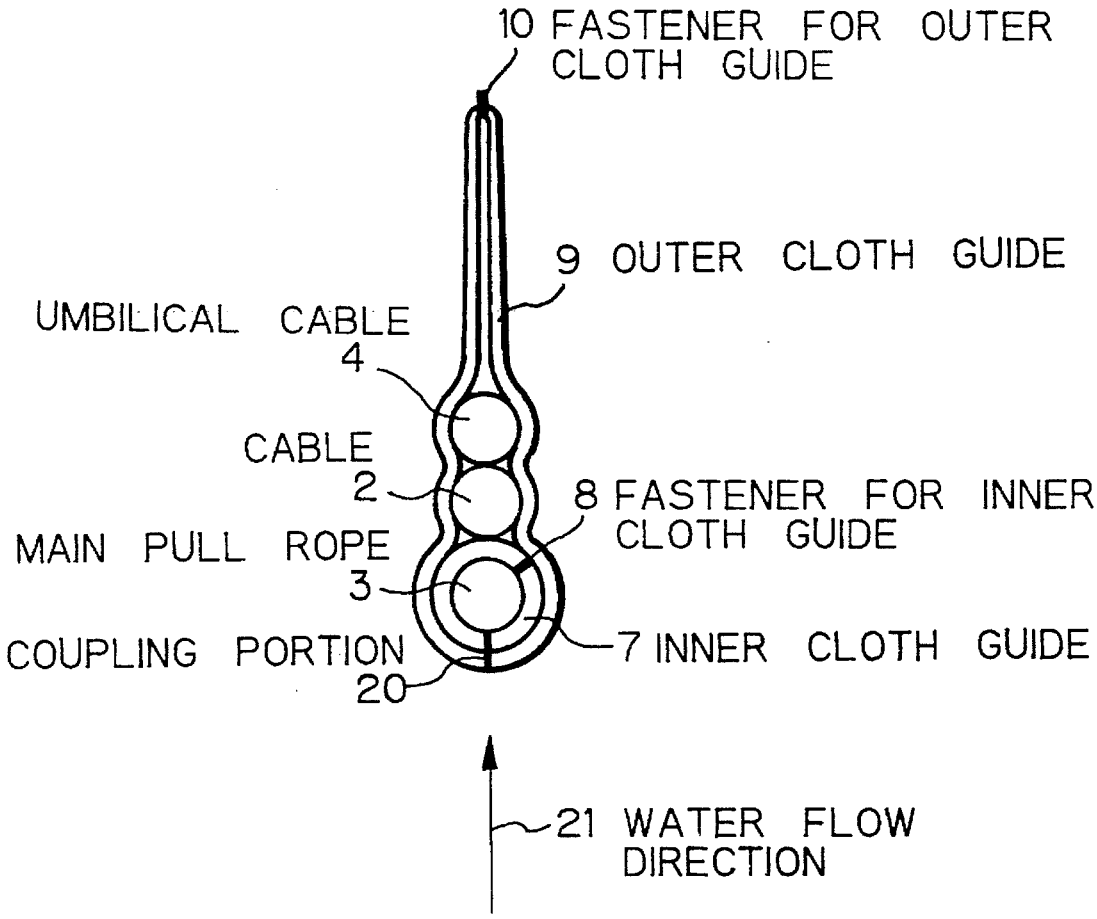
FIG. 2 shows cross section of a cable guide in water according to the present invention.

FIG. 1 is the perspective view of the embodiment of this invention in a barge operation, and FIG. 2 is the cross section of a cloth guide type cable engine in water.

In those figures, the numeral 1 is a barge deck, 2 is a cable, 3 is a main pull rope for pulling a cable butler, 4 is an umbilical cable having cables for control, 5 is a reel on which a flat cloth for an outer cloth guide and a flat cloth for an inner cloth guide are wound, 6 is a pulley, 7 is an inner cloth guide, 8 is a line of a fastener or a seam for an inner cloth guide coupled with a gate, 9 is an outer cloth guide, 10 is a line of a fastener or a seam for an outer cloth guide coupled with a gate, 11 is a cloth guide type cable engine and 12 is a stern chute. The symbol 8' is a slider for fastening or closing (and/or opening) the fastener 8 to provide an elongated cylindrical inner cloth guide, and the symbol 10' is a slider for fastening or closing (and/or opening) the fastener 10 to provide an elongated cylindrical outer cloth guide. A fastener 8 (or 10) is provided at both the sides of a resilient flat cloth guide 7 (or 9), and by coupling the fasteners at both sides by means of a slider 8' (or 10'), a flat cloth guide is closed in the shape of an elongated cylindrical cloth guide.

In operation, an outer cloth guide 9 together with an inner cloth guide 7 wound on a reel 5 change running direction by means of a pulley 6 which has a recess for accepting those clothes 7 and 9. A cable 2 is paid out together with a main pull rope 3, which goes along the seam of the two cloth guides so that an inner cloth guide 7 wraps and fixes tightly a main pull rope 3 by means of a slider 8'.

At the same time, an outer cloth guide 9 wraps automatically both a paid out cable 2 and an umbilical cable 4 in it and fastens a fastener 10 by means of the slider 10', thus, a cloth guide type cable engine 11 according to the present invention is completed, and it is sent out into the sea water through a stern chute 12 on a barge deck 1.

As shown FIG. 2, a main pull rope 3 is wrapped tightly by an inner cloth guide 7, and the inner cloth guide 7, a cable 2 and an umbilical cable 4 are loosely wrapped by an outer cloth guide 9. A main pull rope 3 is wrapped tightly by an inner cloth guide 7 which is located at a fixed position in cross section in an outer cloth guide 9 (generally, it is located at the coupling portion 20 at the bottom of the outer cloth guide 9).

When a cloth guide type cable engine 11 is picked up after paying out operation of a cable, the above mentioned operation would be reversed, and a reel 5 winds up manually or automatically an outer cloth guide 9 at the same speed as that of a main pull rope 3 being wound up.

As a main pull rope 3 is coupled with an outer cloth guide 9 by means of a novel inner cloth guide 7, the power of the brake to a paid out cable, which is conventionally loaded to an outer cloth guide, is instead loaded to the main pull rope 3 with no accumulation of brake force.

Consequently, an excellent cable engine is obtained with no cable tension, and no cable slack. The present invention is used not only for general laying or burying operation, but also for far deep (over 1000 m in depth) sea burying operation. That deep sea burying operation has been impossible although it has been demanded strongly.

Further, according to the present invention, the twist of a cable guiding equipment and the tangle of a paid out cable with a main pull rope would be prevented. A cloth guide type cable engine according to the present invention, therefore, is able to contribute to improve the safety operation of laying and burying cables.

From the foregoing it will now be apparent that a new and improved cloth guide type cable engine has been found. It should be understood of course that the embodiments disclosed are merely illustrative and are not intended to limit the scope of the invention. Reference should be made to the appended claims therefore for indicating the scope of the invention.

What is claimed is:

1. A guide type cable engine comprising:

a main pull rope;

a cable to be paid out;

an inner guide tightly enclosing said main pull rope, said inner guide made of a resilient sheet fastened in an elongated cylindrical shape; and an outer guide enclosing said inner guide, and said cable, said outer guide made of a resilient sheet fastened in an elongated shape, wherein said inner guide is located at a predetermined position in said outer guide.

2. A guide type cable engine according to claim 1, wherein said outer guide further enclosing one of an umbilical cable and a control cable located outside of said inner guide.

3. A guide type cable engine according to claim 1, wherein said inner guide is fastened with a fastener, and said outer guide is fastened with a fastener.

4. A guide type cable engine according to claim 1 wherein said predetermined position is at a coupling portion at a bottom of said outer guide.

* * * * *